United States Patent [19]

Piazzo

[11] Patent Number: 4,879,980

[45] Date of Patent: Nov. 14, 1989

[54] CYLINDER HEAD FOR INTERNAL COMBUSTION ENGINES

[75] Inventor: Diego Piazzo, Turin, Italy

[73] Assignee: Fiat Auto S.p.A., Turin, Italy

[21] Appl. No.: 247,561

[22] Filed: Sep. 22, 1988

[30] Foreign Application Priority Data

Sep. 23, 1987 [IT] Italy ..... 67808 A/87

[51] Int. Cl.[4] ..... F02F 1/47

[52] U.S. Cl. ..... 123/193 H; 123/55 VS; 123/73 PP

[58] Field of Search ..... 123/73 PP, 55 VE, 193 H, 123/65 R

[56] References Cited

U.S. PATENT DOCUMENTS 4,184,462 1/1980 Hale ..... 123/55 VS
4,353,333 10/1982 Iio ..... 123/73 PP
4,802,447 2/1989 Corbett ..... 123/65 R

FOREIGN PATENT DOCUMENTS 184916 9/1985 Japan ..... 123/55 VS

*Primary Examiner*—E. Rollins Cross
*Attorney, Agent, or Firm*—Sughrue, Mion, Zinn, Macpeak & Seas

[57] ABSTRACT

A cylinder head for internal combustion engines for motor vehicles is provided with intake and exhaust manifolds formed integrally by casting and is arranged for the selective application of the fuel supply and ignition members typical of Otto-cycle or Diesel-cycle internal combustion engines respectively.

7 Claims, 4 Drawing Sheets

CYLINDER HEAD FOR INTERNAL COMBUSTION ENGINES

DESCRIPTION

Figure 1:
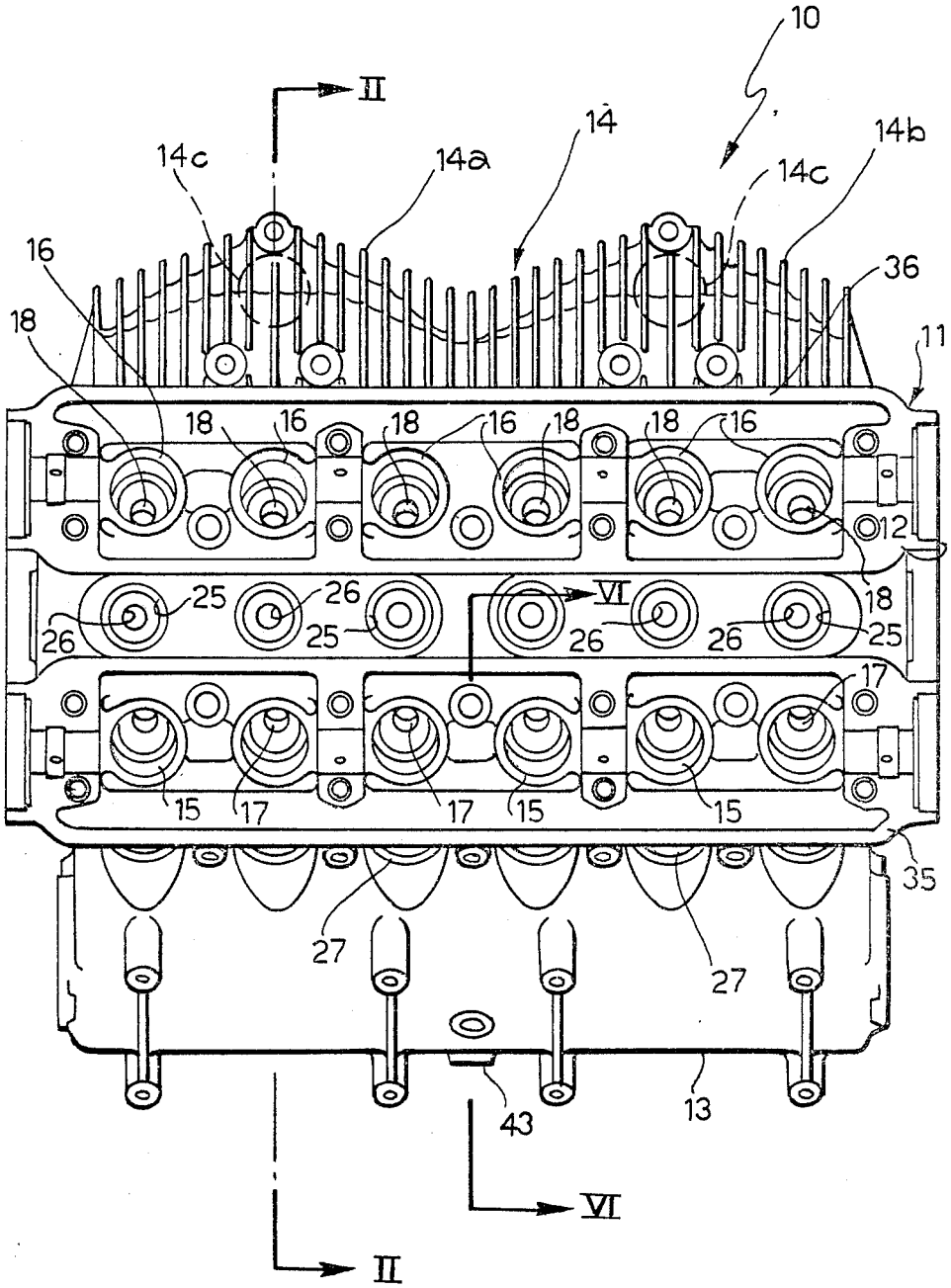

The present invention relates to cylinder heads for internal combustion engines for motor vehicles, of the type comprising a body produced by casting and defining, for each cylinder, a combustion chamber which communicates on opposite sides with an intake duct and an exhaust duct through passages defined by respective intake and exhaust valve seats.

The object of the present invention is to provide a cylinder head of the type defined at the beginning, which is provided with a rational and functional configuration and, in particular, can be adapted by a few simple and cheap operations to the various types of internal combustion engine (aspirated or supercharged Otto-cycle with injection or carburation—aspirated or supercharged Diesel-cycle) usually installed in motor vehicles.

According to the invention, this object is achieved by virtue of the fact that:

the intake ducts and exhaust ducts open into respective intake and exhaust manifolds which are formed integrally with the body of the head by casting, the integral intake and exhaust manifolds can be removed from the body of the head by milling, as a result of which the body is arranged for the fitting of added manifolds, the body is arranged for the selective application of the fuel supply and ignition members typical of Otto-cycle of Diesel-cycle internal combustion engines respectively.

More particularly, the body has an intermediate hole between the intake and exhaust valve seats of each pair for selectively housing a sparking plug for Otto-cycle engines or a precombustion chamber with injectors for Diesel-cycle engines.

Conveniently, the body of the head has a cavity above each intake duct, which, if the head is intended for use on an Otto-cycle injection engine, is adapted to be put into communication with the respective intake duct by means of a hole and to house a fuel injector. The body also has a receptacle substantially above each exhaust duct, which, if the head is intended for use on a Diesel-cycle engine, is adapted to house a glow plug operatively associated with a fuel injector and the precombustion chamber.

According to another characteristic of the invention, the lower side of the body of the head, which is intended to bear on the engine block, is levelled flush with the outlets of the exhaust manifold.

To advantage, the body of the head is also provided with a "blow-by" passage formed by casting and terminating at the height of the intake manifold.

According to a further characteristic of the invention, the valve seats of each pair are arranged to house intake and exhaust valves of equal lengths and diameter, and are arranged symmetrically on opposite sides of a median plane of the head which passes through the axes of the intermediate holes.

By virtue of these characteristics, the head according to the invention is suitable for use, with minimum adaptation, on practically all types of engine currently fitted in motor vehicles. In practice, this enables the head castings to be standardised, with obvious advantages in terms of making the production less onerous.

Figure 2:
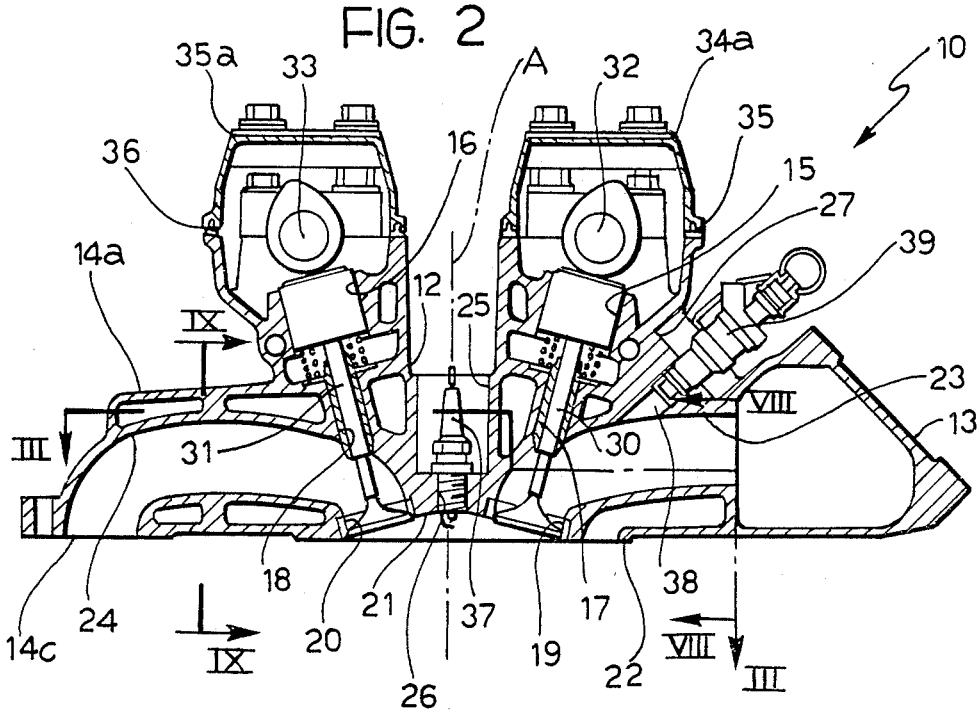
Figure 3:
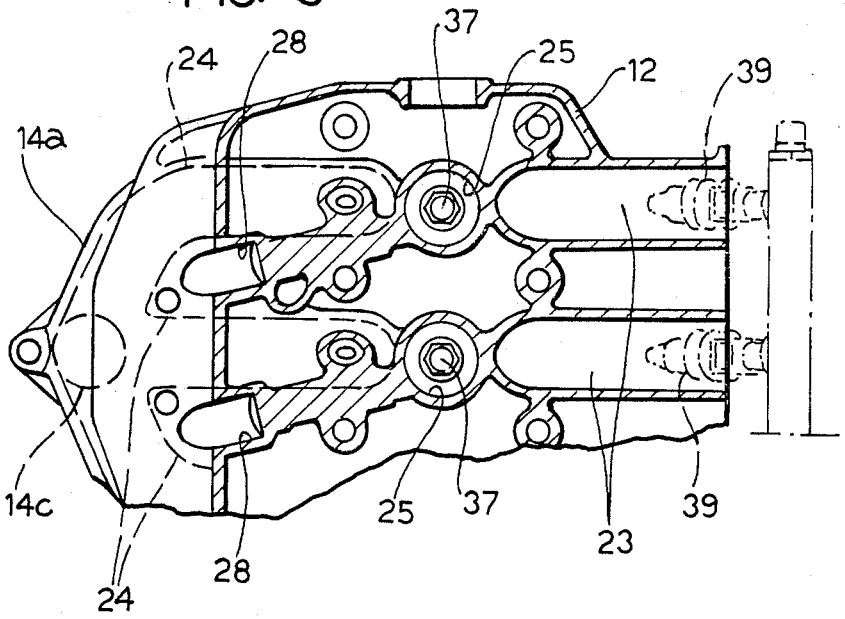
Figure 4:
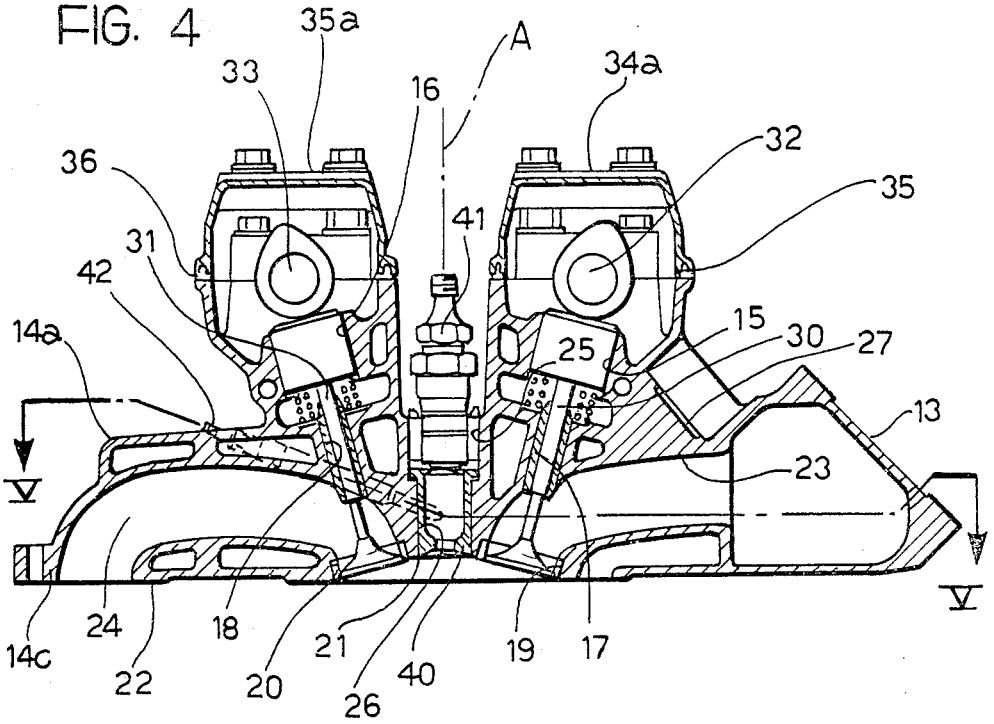
Figure 5:
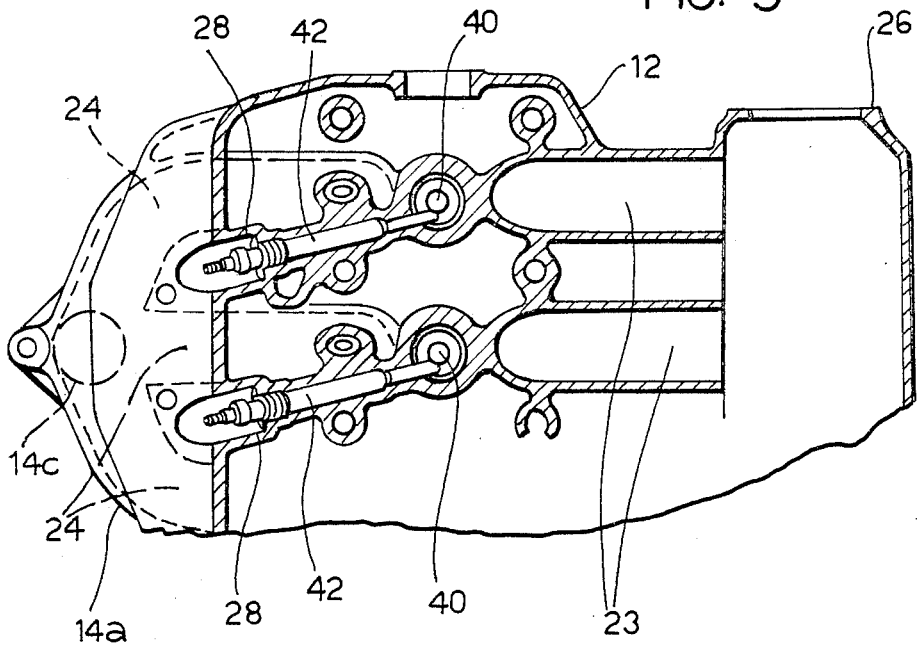
Figure 6:
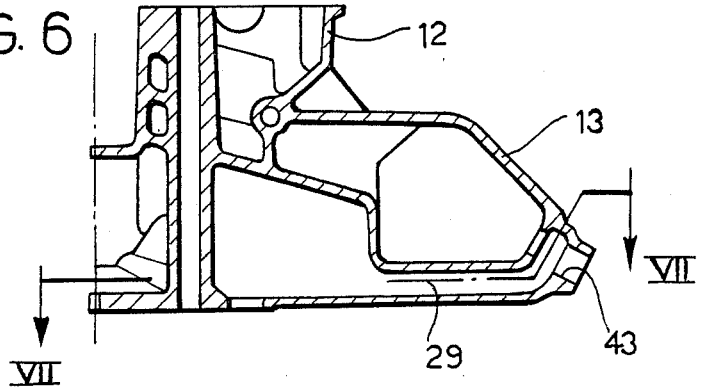
Figure 7:
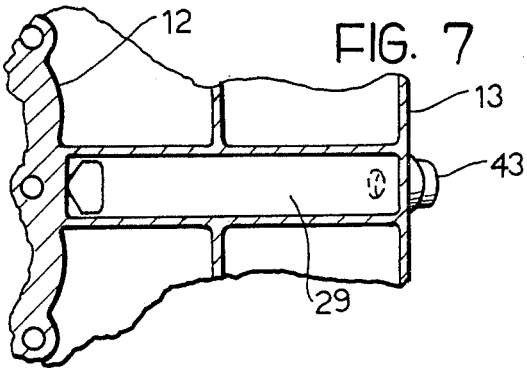
Figure 8:
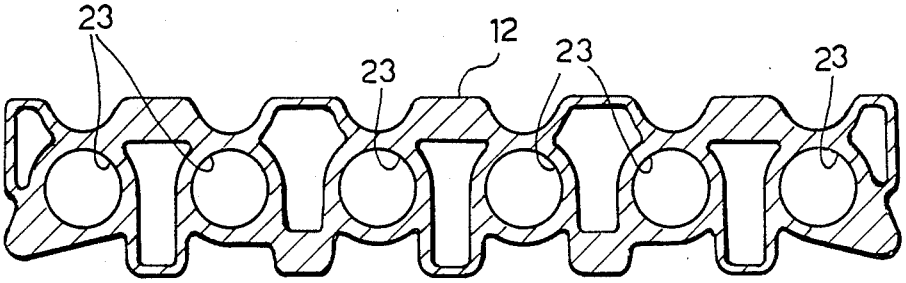
Figure 9:
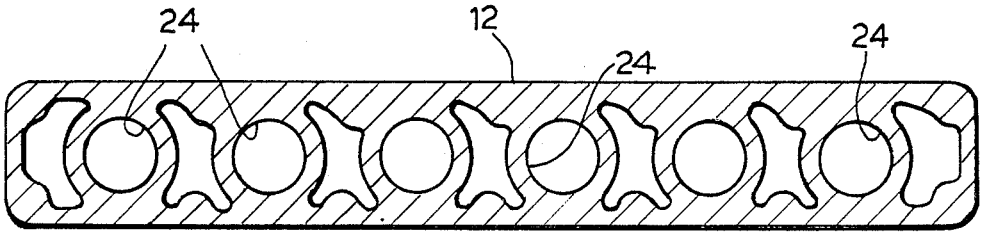

The invention will now be described in detail with reference to the appended drawings, provided purely by way of non-limiting example, in which:

FIG. 1 is a plan view from above of a cylinder head for internal combustion engines, according to the invention, FIG. 2 is a cross-section taken on the line II—II of FIG. 1, showing the head in its configuration for use on an Otto-cycle injection internal combustion engine, with the respective fuel supply and ignition members, FIG. 3 is a section taken on the line III—III of FIG. 2, FIG. 4 is a view similar to FIG. 2, showing the head in its configuration for use on a Diesel-cycle internal combustion engine with the respective fuel supply members, FIG. 5 is a section taken on the line V—V of FIG. 4, FIG. 6 is a cross-section taken on line VI—VI of FIG. 1, FIG. 7 is a section taken on the line VII—VII of FIG. 6, FIG. 8 is a section taken on the line VIII—VIII of FIG. 2, and FIG. 9 is a section taken on the line IX—IX of FIG. 2.

With reference initially to FIG. 1, a cylinder head for internal combustion engines for motor vehicles, according to the invention, is generally indicated 10 and is constituted by a single metal body 11 produced by casting by conventional techniques.

In the case of the example illustrated, the invention relates to the application to a six-cylinder, in-line engine: however, it should be noted that the invention can be applied more generally to motor vehicles with a different number of cylinder.

The body 11 is constituted essentially by a middle section 12 from the sides of which an intake manifold 13 and an exhaust manifold, generally indicated 14, extend.

The middle section 12 has a plurality of pairs of tubular bosses 15, 16 aligned in two rows on opposite sides of and equidistant from a vertical median plane of symmetry A (FIG. 2) of the head 10, and corresponding in number to the number of cylinders of the engine for which the head is intended. Each boss 15, 16 is aligned axially with a respective guide hole 17, 18 and with a respective hole 19, 20 defining an annular valve seat. The valve seats 19 and 20 are formed in respective lower walls 21 intended to delimit the top of the combustion chamber of the respective cylinder when a lower flat bearing surface 22 of the head 10 is fitted onto the engine block.

The holes 19 and 20 communicate with respective intake and exhaust ducts 23, 24 of which the former open into the intake manifold 13 formed integrally with the body 11 by casting. The exhaust ducts 24 open into the exhaust manifold 14 which, in the embodiment illustrated with reference to the case of a six-cylinder engine, is formed in two sections **14*a*, 14*b* also formed integrally with the body 11 by casting, the exhaust ducts 24 from three cylinders leading into each section. The two sections 14*a*, 14*b* have respective lower outlets 14*c* which are flush with the lower bearing surface 22 of the head 10** and to which exhaust pipes, not illustrated, are intended to be connected.

The middle section 12 of the body 11 has a central row of cylindrical seats 25 interposed between the bosses 15, 16 of the six pairs and having their respective axes situated in the median plane of symmetry A of the head 10. Each seat 25 opens on to the wall 21 through a respective hole 26.

The middle section 12 of the body 11 also has cylindrical seats 27 with inclined axes, overlying the six intake ducts 23, and receptacles 28, also with inclined axes, substantially overlying the exhaust ducts 24.

With reference now to FIGS. 6 and 7, a "blow-by" passage, indicated 29, is formed directly in the body 11 of the head 10 by casting and terminates at the height of the intake manifold 13 which has a hole in correspondence with a connector 43 (when the head 10 is used for aspirated engines) for its connection. For application to supercharged engines, the connector 43 is connected as usual.

By virtue of the above-described conformation, the head 10 is useable, with minimum adaptation, for all types of internal combustion engine used for automotive applications. In all the possible applications, which will be described in detail below, the annular bosses 15, 16, with their guide holes 17, 18 and their annular seats 19, 20, house respective intake valves 30 and exhaust valves 31 with respective mechanical or hydraulic tappets which are absolutely identical to each other. The valves 30 and 31 are intended to be operated on a conventional manner by means of cam shafts 32, 33 enclosed in respective casings, 34*a*, 35*a* fixed to the middle section 12 of the body 11 of the head 10 in correspondence with respective flanges 35, 36.

If the head 10 is intended for use in an Otto-cycle injection engine, the central holes 26 are threaded to receive respective sparking plugs 37. In this case, the cylindrical seats 27 are put into communication with the respective intake ducts 23 by the formation of holes 38 and house respective conventional petrol injectors 39. This configuration is illustrated in FIGS. 2 and 3.

If the head 10 is intended for application to a Diesel-cycle engine, however, the configuration is that shown in FIGS. 4 and 5. In this case, the central holes 26 are enlarged to house respective precombustion chambers 40 with respective diesel-oil injectors 41. The cylindrical seats 27 are not used, whilst the respective glow plugs 42 are inserted in the receptacles 28 and communicate at their inner ends with the respective precombustion chambers 40.

In both cases, the head 10 may be used for aspirated engines and for supercharged engines.

As well as the configurations described above, the head 10 can also be used for further applications by means of supplementary modifications. For example, it may be transformed into a normal head by the removal of the integral intake and exhaust manifolds 13 and 14. This may be achieved by means of two simple millings along the planes identified by the sections VIII—VIII and IX—IX (FIG. 2), so as to enable corresponding conventional added manifolds to be fixed. Thus, the head 10 can be used for Otto-cycle carburettor engines and/or for engines with exhaust ducts which extend sideways instead of downwards.

Finally, by virtue of its symmetry relative to the median axis A, the head 10 may be mounted equally well in the position illustrated in the drawings or in a position in which it is rotated through 180° in the horizontal plane, so that it is thus possible to fit the exhaust of the engine at the front or the rear according to the requirements of the motor car in which the engine is to be installed.

I claim:

1. A cylinder head for internal combustion engines for motor vehicles, comprising a body produced by casting and defining, for each cylinder, a combustion chamber which communicates on opposite sides with an intake duct and an exhaust duct through passages defined by respective intake and exhaust valve seats, wherein:

the intake ducts and the exhaust ducts open into respective intake and exhaust manifolds which are formed integrally with the body of the head by casting, the integral intake and exhaust manifolds can be removed from the body of the head by milling, as a result of which the body is arranged for the fitting of added manifolds, the body is arranged for the selective application of the fuel supply and ignition members typical of Otto-cycle or Diesel-cycle internal combustion engines respectively.

2. A head according to claim 1, wherein the body has an intermediate hole between the intake and exhaust valve seats of each pair for selectively housing a sparking plug for Otto-cycle engines or a precombustion chamber with a fuel injector for Diesel-cycle engines.

3. A head according to claim 2, wherein the body has a cavity above each intake duct, which is adapted to be put in communication with the respective intake duct by means of a respective hole and to house a fuel injector if the head is intended for use on an Otto-cycle injection engine.

4. A head according to claim 2, wherein the body has a receptacle substantially above each exhaust duct which is adapted to house a glow plug operatively associated with the precombustion chamber if the head is intended for use in a Diesel-cycle engine.

5. A head according to claim 1, wherein the lower side of the body, which is intended to bear on the engine block, is levelled flush with the outlets of the exhaust manifold.

6. A head according to claim 1, wherein the body is provided a "blow-dry" passage formed by casting and terminating at the height of the intake manifold.

7. A head according to claim 2, wherein the valve seats of each pair are arranged to cooperate with respective intake and exhaust valves of equal length and diameter, and are arranged symmetrically on opposite sides of a median plane of symmetry of the body which contains the axes of the intermediate holes.

* * * * *